United States Patent [19]

Langford, Jr.

[11] Patent Number: 4,722,405

[45] Date of Patent: Feb. 2, 1988

[54] WEAR COMPENSATING ROCK BIT INSERT

[75] Inventor: James W. Langford, Jr., Red Oak, Tex.

[73] Assignee: Dresser Industries, Inc., Dallas, Tex.

[21] Appl. No.: 914,205

[22] Filed: Oct. 1, 1986

[51] Int. Cl.[4] ..... E21B 10/52

[52] U.S. Cl. ..... 175/374; 175/410; 75/242; 76/108 A; 76/DIG. 11

[58] Field of Search ..... 175/410, 374; 75/240, 75/242; 76/108 A, DIG. 11; 299/79, 94; 51/309

[56] References Cited

U.S. PATENT DOCUMENTS

| | | | |
|---|---|---|---|
| 2,108,797 | 3/1938 | Comstock | 75/137 |
| 2,888,247 | 5/1959 | Haglund | 175/410 |
| 3,311,181 | 3/1967 | Fowler | 175/410 |
| 3,581,835 | 6/1971 | Stebley | 175/409 |
| 3,677,722 | 7/1972 | Rymas | 29/182.8 |
| 3,790,353 | 2/1974 | Jackson et al. | 29/182.7 |
| 3,882,749 | 5/1975 | Tourek | 83/651 |
| 3,937,618 | 2/1976 | Kirkham | 29/182.2 |
| 3,999,954 | 12/1976 | Kolaska et al. | 29/182.7 |
| 4,082,559 | 4/1978 | Mishuku et al. | 106/43 |
| 4,148,368 | 4/1979 | Evans | 175/410 X |
| 4,194,790 | 3/1980 | Kenny et al. | 299/79 |
| 4,262,761 | 4/1981 | Crow | 175/374 |
| 4,289,833 | 9/1981 | Hachisuka | 428/544 |
| 4,339,009 | 7/1982 | Busby | 175/410 X |
| 4,359,335 | 11/1982 | Garner | 75/208 |
| 4,368,788 | 1/1983 | Drake | 175/374 |
| 4,533,004 | 8/1985 | Ecer | 175/329 |
| 4,595,067 | 6/1986 | Drake | 175/331 |

*Primary Examiner*—Stephen J. Novosad

*Attorney, Agent, or Firm*—Richards, Harris, Medlock & Andrews

[57] ABSTRACT

A composite sintered rock bit insert for use in a rolling cutter is fabricated from two tungsten carbide components. The first component is formed of a tungsten carbide composite that is less wear resistant, but tougher, than the second component. The two components are joined at a parting plane which extends to an earth-engaging surface of the insert. The insert is mounted on a rolling cutter such that the component having the lower wear resistant properties is on the leading face of the insert. With this combination, the wear pattern of the insert maintains a crest-like configuration at its rock engaging surface.

39 Claims, 11 Drawing Figures

WEAR COMPENSATING ROCK BIT INSERT

TECHNICAL FIELD

The present invention relates to rolling cutter drill bits, and more particularly, to sintered inserts for such bits fabricated from materials having different abrasion resistance and toughness properties.

BACKGROUND ART

Sintered tungsten carbide inserts are regularly used in the rolling cutter of rotary drill bits. Although such materials are highly wear resistant, because of the severe conditions in which the bits operate, inserts become dull or blunted with use, resulting in inefficiency and increased energy requirements to accomplish drilling or requiring removal of the bits from service and replacement with new ones.

Generally, the prior art has consistently attempted to overcome the problems associated with wear of drill bit inserts by fabricating the inserts from more abrasion resistant grades of tungsten carbide. The grade of the tungsten carbide is selected depending upon the formation to be cut and conditions encountered in any particular installation. A bit having high abrasion resistance will have a greater wear life but is more brittle and thus more susceptible to fracture. Thus, under severe cutting conditions, a relatively tough grade of carbide may be selected to reduce the tendency of an insert to fracture. However, while the tougher grades of tungsten carbide are less brittle, they are also relatively soft, having less resistance to wear, and therefore, the rotary drill bit will have a short life due to blunting of the insert tip.

Although prior art rotary drill bits have combined two tungsten carbide materials in a single bit to change wear characteristics, the approach taken by prior devices has been to apply a layer of harder grade tungsten carbide on the wear face of the insert with a softer grade therebehind. Examples of bits having this design are disclosed in U.S. Pat. No. 4,194,790 issued to Kenny, et al. and U.S. Pat. No. 4,359,335 issued to Garner. The patent issued to Garner is to an insert designed for the gage row of a rotary drill bit, the harder tungsten carbide being applied to the face defining the gage of the bore hole being drilled. In the Kenny, et al. patent, the harder material is placed on the forward or cutting surface.

It will be noticed that these dual component rock bit inserts of the prior art employ a relatively thin layer of a harder grade of tungsten carbide on a relatively thicker base of a tougher carbide material and the harder grade of tungsten carbide forms the earth engaging face of the insert. The useful life of these hybrid rock bit inserts is limited by the relative thickness of the harder carbide material, with the effectiveness of the inserts being greatly reduced once the harder material has been worn to a blunt surface or completely removed by wear or fracturing during drilling. Further, the hybrid dual component rock bit inserts of the prior art have a low drilling efficiency due to the normal wear of the harder carbide component, which component tends to be blunted or broken during use.

The rock bit inserts of the prior art, whether hybrid dual component inserts, wherein the harder component provides the earth engaging surface, or single component inserts, have a crest-like tip which produces a greater stress on the contacted rock. Although this profile provides for more efficient and effective drilling, the insert tips of the prior art, if formed of a relatively soft tungsten carbide, have the disadvantage of rapidly dulling or blunting during normal use or of fracturing to an inefficient drilling configuration if fabricated from relatively harder carbide materials.

SUMMARY OF THE INVENTION

The present invention provides a composite sintered rock bit insert, for use in a rolling cutter, fabricated from two tungsten carbide components. Although both tungsten carbide components have very high wear resistant properties, the first component is formed of a tungsten carbide composite that is less wear resistant but tougher, that is having a higher rupture strength, than the second component. Thus, the second component is more wear resistent, yet more brittle. The two components are joined at a parting or mating plane which extends to an earth-engaging surface of the insert. The insert is oriented on the rolling cutter such that the tougher component, that is the component having the lower wear resistant properties, is on the leading face of the insert. The second component is positioned on the insert to define the trailing face.

By employing two components in forming the insert, with one wearing more readily than the other, the wear pattern of the insert maintains a crest-like configuration at the rock engaging surface but with the top of the crest shifted toward the trailing face such that the leading face has a more angular slope relative to the longitudinal axis of the insert than the trailing face. This wear pattern maintains a smaller rock engaging area for contact with the borehole bottom than would occur if the insert were blunted by uniform wear. Thus, the insert produces a greater stress on the contacted rock and maintains a better digging profile thereby providing for more effective drilling. Further, the composite insert has a transverse rupture strength which is far greater than that of the low rupture strength material and only slightly less than that of the high rupture strength material.

In one embodiment of the invention, the composite sintered rock bit insert of the present invention has a first component comprising sintered tungsten carbide containing about 16% by weight cobalt, and a second component, comprising sintered tungsten carbide containing about 14% by weight cobalt. As a result, the first component is less wear resistant but of superior toughness as compared to the second component, and the second component is more wear resistant but more brittle than as the first component.

The mechanism by which the second component is made harder than the first may be other than by variation in the cobalt content. For example, the average grain size of the tungsten carbide also determines the hardness of the material, and thus this mechanism, either used along or in combination with cobalt content, may be used to produce the relatively hard and soft tungsten carbide in the present invention.

In accordance with another aspect of the invention, a composite sintered rock bit insert includes a body having a substantially cylindrical base on one end for mounting in a rock bit, and a tip extending from said base on the opposite end. The tip converges inwardly from the base and terminates in a generally convex earth engaging surface (this contemplates a flat crest with rounded terminuses). The tip is formed from a first component joined along a mating plane to a second component, the first component having a resistance to wear less than that of the second component. The mating plane substantially equally divides the tip and engages the generally convex surface. Further, the mating plane is oriented substantially perpendicular to the direction of movement of the insert on the rock bit cutter as the rock bit cutter is rotated during drilling.

BRIEF DESCRIPTION OF THE DRAWINGS

For a more complete understanding of the present invention, and further details and advantages thereof, reference is now made to the following Detailed Description taken in conjunction with the accompanying drawings, in which.

DETAILED DESCRIPTION

The present invention is to a composite sintered rock bit insert fabricated from two tungsten carbide components. The first and second components of the insert are joined at a mating plane which extends to an earth engaging surface, which surface has a crest-like configuration. The insert is mounted in a rolling cutter drill bit such that the first composite is on the leading edge of the insert as the bit rotates. The second component is fabricated to have a greater resistance to wear, so that during use, the first surface wears at a greater rate than does the second surface producing a wear pattern that maintains the general crest-like configuration at the earth engaging surface of the insert.

Generally, tungsten carbide materials are very wear resistant and are well suited as inserts in rock drilling bits. Although tungsten carbide components are highly wear resistant, it is well known that the more resistant a carbide material is, the more brittle it is. At least two factors which determine the relative toughness/abrasion resistance characteristics of tungsten carbide are:

1. the cobalt content of the tungsten carbide material, where the harder, more wear resistant material has less cobalt and where the softer, but more tough material has more cobalt; and 2. the grain size of the tungsten carbide material, where the harder, more wear resistant material has a relatively small grain size and where the softer, more tough material has a relatively large grain size.

The present invention contemplates a composite sintered rock bit insert having a first and second components comprising sintered tungsten carbide but having differing percentages by weight of cobalt and/or grain size of tungsten carbide so that the first component has less wear resistance but greater toughness as compared to the second component, which is more wear resistant, i.e., harder but more brittle or fragile.

Figure 1A:
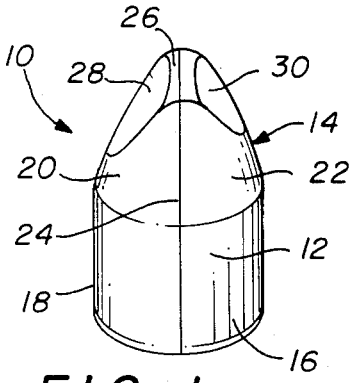
FIG. 1*a* is a perspective view of the rock drill bit insert of the present invention.
Figure 1B:
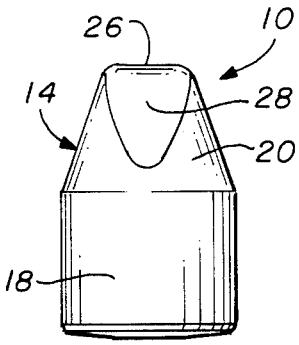
FIG. 1*b* is a front elevation view of the insert.
Figure 1C:
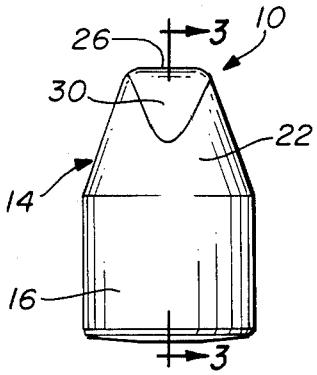
FIG. 1*c* is a back elevation view of the insert.

Referring to FIGS. 1*a,* 1*b* and 1*c,* rock bit insert 10 has a body 12 with a cutting tip 14 at one end and a base 16 at the opposite end. Base 16 is cylindrical and includes a grip length 18. Body 12 is composed of a first component 20 and a second component 22 with a mating plane 24 therebetween. As is shown in FIGS. 1*a,* 1*b* and 1*c,* tip 14 defines a section which converges inwardly from the base and has a blunted crest 26 with flats 28 and 30 on opposite sides thereof. Flat 28 is formed on component 20 and flat 30 is formed on component 22. The differences in the sizes of flats 28 and 30 are for the purpose of distinguishing the first component from the second component so that the insert can be installed in the proper orientation as discussed below. Because the mating plane 24 between the components is not readily visible to the eye upon final fabrication of the insert, a means for distinguishing the components is necessary. However, it will be understood that other means can be used to distinguish component 20 from component 22, such as by adding identifying indicia in the base.

While tip 14 of insert 10 has a shape which is converging inwardly from base 16 with crest 26 formed at the top thereof, and flats 28 and 30 extending from crest 26, it will be understood that other shapes, such as more defined conical shapes or wedges, for example, may be used. The particular geometry of the configuration of tip 14 may be preselected during the fabrication stages so as to yield the most efficient rock crushing, grating or gouging effect during use, depending upon the particular rock structures and other geological formations to be encountered.

Figure 2:
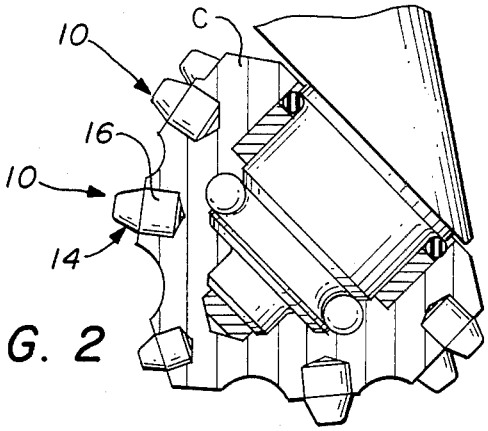
FIG. 2 is a partial section view showing the rock bit insert of the present invention mounted on a rolling cutter bit cone.

FIG. 2 illustrates a typical rock bit roller cone C having a plurality of rock bit inserts 10 mounted therein. As is seen in FIG. 2, rock bit inserts 10 are mounted with their bases 16 engaged within the roller cone C having their cutting tips 14 extending outwardly from the rock bit cone. Inserts 10 may be positioned with their longitudinal axis along radii from the center of roller cone C.

Figure 3:
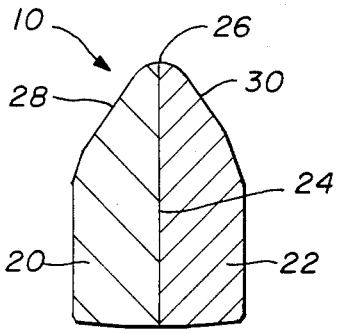
FIG. 3 is a section view of the insert of the present invention taken line 3—3 of FIG. 1*c;*

As is best seen in FIGS. 1*a* and 3, in the preferred embodiment, insert 10 is made of two substantially equal halves, namely first component 20 and second component 22. Generally, component 20 will be a tungsten carbide material having a higher cobalt content than that of component 22, so that component 20, while having a lower hardness rating, and less abrasion resistance, will have a higher transverse rupture strength (TRS). In accordance with the invention, component 20 will serve as the leading edge of insert 10, and component 22, having a higher wear resistance, but being less tough, will be the trailing edge of the insert. Thus, as roller cone C rotates about its axis, insert 10 is mounted therein such that the mating plane 24 is substantially perpendicular to the rotational direction with component 20 on the leading face (that is, mating plane 24 substantially passes through the rotational axis of cone C). As is shown in FIG. 3, an unworn insert has a crest-like structure forming a generally convex crest 26. In the preferred embodiment, mating plane 24 bisects insert 10 through the longitudinal axis of the insert to form two substantially equal halves. It will be understood, however, that while this is the preferred arrangement, mating plane 24 may be removed from the longitudinal axis thereby not bisecting the insert into two equal halves. Further, the insert may be made such that the mating plane 24 between the first and second components is not a planar surface, but may be curved or stepped. Further, the mating plane 24 need not necessarily be parallel to the elongate axis but may have an angular disposition with respect to the axis. However, in the preferred embodiment, the mating plane is positioned substantially such that it is normal to the direction of movement of the insert as the roller cone is rotated, with a plus or minus 10° variance from this position.

Figure 4A:
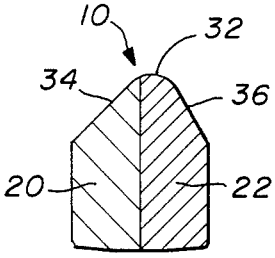
FIG. 4*a* through 4*c* are section views of the insert of the present invention showing progressive stages of wear of the insert during use.

Referring now to FIG. 4*a*, insert 10 is shown in the early stages of wear, where tip 14 has been eroded to form a new crest 32 having a relatively small radius of curvature. It will be noted that component 20 has been worn to form face 34, and component 22 has been worn to form face 36, the faces being at the base of crest 32. Crest 32 provides a smaller contact area for engaging the borehole bottom than would occur if the insert were blunted uniformly. Because the same downhole weight is distributed over this smaller area, the tool produces a greater stress on the contacted rock to fracture it, providing more effective drilling. Further, not only is the stress on contacted rock higher as a result the smaller area of the crest, the insert maintains a shape that is more efficient in "digging" as the tool bit is rotated.

Figure 4B:
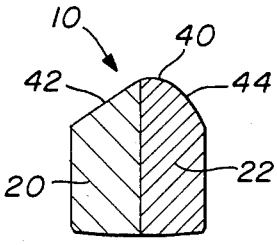

Referring to FIG. 4*b*, insert 10 is shown at a state of wear greater than that shown in FIG. 4*a*, where crest 32 has been further worn to form crest 40. Component 20 has been further worn to form face 42, and component 22 has been further worn to form face 44. While crest 40 has a slightly larger radius of curvature than does crest 32, crest 40 is still of a smaller area than would exists if the insert were blunted uniformly, and thus the insert concentrates the downhole weight of the drilling structure on the borehole bottom to produce a greater stress on the contacted rock to effect efficient fracturing of the rock. Likewise, the insert takes on a shape which is more efficient in "digging" or gouging as the bit is rotated.

Figure 4C:
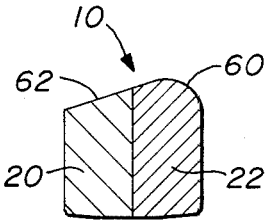

Referring now to FIG. 4*c*, insert 10 is shown at a still greater state of wear than as shown in FIG. 4*b*, where crest 40 has been worn to form crest 60, and component 20 has been worn to form face 62. It will be understood that former face 44 on component 22 becomes incorporated with crest 60 at the state of wear shown in FIG. 4*c*. As seen in FIG. 4*c*, crest 60 has a sufficiently small radius of curvature so as to maintain an increased stress at the contact point between the bit and rock formation, thereby effecting efficient rock fracturing.

As can be seen from the foregoing disclosure, the design of the present invention provides a wear compensating feature which maintains a crest-like configuration on the tip of the bit insert. Although this progressively changing crest-like configuration defines a geometry which is less "sharp" than the original insert shape, it is always "sharper" than the geometry which would result under uniform wear of the insert tip.

In a preferred embodiment of the invention, the first tungsten carbide component of the rock bit insert will have a Rockwall hardness (Ra) of from between about 85 and 86, and the second component will have a Rockwall hardness of from between about 86 and 93. While the relative hardness of the first component is lower than that of the second component, the toughness of the first component is relatively greater. In particular, the toughness of the first component, as measured by the component's transverse rupture strength (TRS), measured in pounds per square inch (psi), is about 425,000 psi, while the TRS of the second component generally ranges from between about 410,000 psi to about 310,000 psi.

Further, the tungsten carbide material of the first component of the present invention will generally have an average grain size of from between about 4.5 to 6.5 microns, while the average grain size for the second component ranges from between about 1 to 6.5 microns.

Examples of compatible first and second components are set forth in table 1 below.

TABLE 1

| EXAMPLE | FIRST COMPONENT | SECOND COMPONENT |
|---|---|---|
| | EXAMPLE A | |
| % cobalt | 16 | 14 |
| TRS (psi) | 425,000 | 410,000 |
| Grain Size (microns) | 4.5–6.5 | 4.5–6.5 |
| Wear No. | 240 | 260 |
| Hardness Ra | 85.4–86.2 | 86–87 |
| | EXAMPLE B | |
| % Cobalt | 16 | 15 |
| TRS (psi) | 425,000 | 415,000 |
| Grain Size (microns) | 4.5–6.5 | 1–2.5 |
| Wear No. | 240 | 620 |
| Hardness Ra | 85.4–86.2 | 87.7–89 |
| | EXAMPLE C | |
| % Cobalt | 16 | 5.8 |
| TRS (psi) | 425,000 | 310,000 |
| Grain Size (microns) | 4.5–6.5 | 1–2.5 |
| Wear No. | 240 | N/A |
| Hardness Ra | 85.4–86.2 | 91–92.5 |

It has been found that when composites of the present invention are formed, the TRS of the composite is considerably tougher than the least tough tungsten carbide component alone. For instance, the low transverse rupture strength material in Example C of Table 1 is 310,000 psi. However, when joined in the manner of this invention, the transverse rupture strength of the composite is 413,000 psi. By joining the tungsten carbide materials of different properties, a resultant composite is made which has enhanced properties when compared to either of the materials alone. Specifically, the TRS of the composite is greater than that of the low rupture strength material, and thus, the composite is less brittle and can withstand greater impact and shear loading. Further, because of the use of back to back components with the leading face material being less wear resistant, the insert maintains a crest-like configuration of its tip which mechanically improves the digging efficiency of the bit.

Judicious selection of materials provides a composite with controlled toughness and wear characteristics that enhance the drilling life of the insert. Further, proper selection of materials provides a downhole wear pattern on the composite that compensates for material lost from the original shape, thereby retaining the crest-like configuration on the drilling insert regardless of the time spent downhole or the state of wear thereof.

Further, proper selection of materials provides composite materials that can be used for drilling dissimilar formations. This is a result of the overall improved rupture strength of the composite while providing improved drilling ability due to the wear compensating feature. Such characteristics are impossible to obtain in a single grade of insert material or in multiple grades uniformly mixed together.

Figure 5:
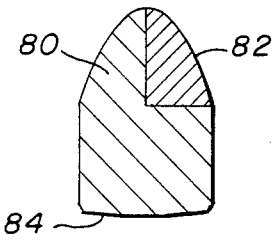
FIG. 5 is a sectional view of a second alternative embodiment of the present invention.
Figure 6:
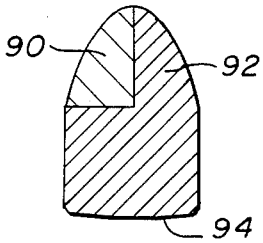
FIG. 6 is a section view of a third embodiment of the present invention.
Figure 7:
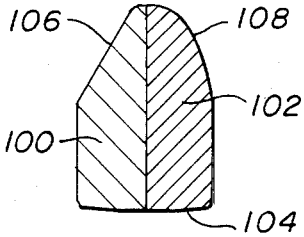
FIG. 7 is a section view of a fourth embodiment of the present invention.

FIGS. 5, 6 and 7 illustrate alternative embodiments of the rock bit insert of the present invention. In FIG. 5, rock bit insert 84 consists of components 80 and 82, where component 80 is of superior toughness and forms the leading face of insert 84 during grating operations. Component 82 is a tungsten carbide material having relatively greater hardness and forms the trailing face of insert 84 during drilling. As seen in FIG. 5, all of the base of insert 84 is formed of component 80. The tip of insert 84 is made of substantially equal amounts of components 80 and 82.

In the embodiment of FIG. 6, insert 94 is made of components 90 and 92, where component 90 is of greater toughness than component 92, and component 92 is of greater hardness than component 90. Again, the tougher material serves to form the leading face of the insert during grating operations. Further, the tip of insert 94 is formed of component 90 and component 92, while the base of the insert is part of component 92.

In FIG. 7, an alternative embodiment is shown where insert 104 comprises component 100 and component 102, where component 100 has face 106 and component 102 has face 108, the latter face being arcuate, as opposed to flat. Component 100 has lower wear resistance, but is tougher, than component 102 which has greater wear resistance but is more brittle than component 100.

Thus, the present invention provides a composite sintered rock bit insert fabricated from two carbide components. The first component has a lower wear resistance but a higher rupture strength than the second component. The second component is more wear resistant, yet more brittle. The two components are joined at a parting or mating surface, and in the preferred embodiment, the inserts are positioned on a rock bit rolling cone such that the first component is the leading face of the insert. By using two components and forming the insert with one wearing more rapidly than the other, the wear pattern of the insert maintains a crest-like configuration at the rock engaging surface. This configuration provides a smaller rock-engaging area for contact with the borehole bottom than would occur if the insert were blunted by uniform wear and thus produces a greater stress on the contacted rock to provide for more effective drilling. Further, the composite insert has a rupture strength which is far greater than that of the low rupture strength material and only slightly less than that of the high rupture strength material. Thus, the invention provides a rock bit insert which incorporates a wear compensating feature that maintains a crest on the insert, thereby improving the design of the insert for cutting efficiency during use, and also provides a composite transverse rupture strength to withstand high impact and shear loading.

Although preferred embodiments of the invention have been described in the foregoing Detailed Description and illustrated in the accompanying Drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

I claim:

1. A sintered rock bit insert for attachement to a rolling rock bit cutter comprising:

a body having a first portion comprised of a first material and joined to a second portion comprised of a second material, said first material having a wear resistance lower than that of said second material, said insert being adapted for insertion into said rock bit cutter with a portion of said body exposed and with the first portion positioned such that it is the leading edge of the body as said cutter is moved to effect cutting, the first portion of said body being joined to the second portion of said body along a mating plane which is oriented substantially perpendicular to the direction of movement of said insert on the rock bit cutter as the rock bit cutter is moved to effect cutting.

2. The rock bit insert according to claim 1 wherein said first material is sintered tungsten carbide and said second material is sintered tungsten carbide, the first material having a hardness less than that of said second material such that said first material has a lesser resistance to wear than the second material.

3. The rock bit insert according to claim 1 wherein said first and second materials comprise sintered tungsten carbide with said first material having a greater percent by weight of cobalt than said second material.

4. The rock bit insert according to the claim 1 wherein said mating plane substantially divides said insert into two equal halves.

5. The rock bit insert according to claim 1 wherein said body has a cylindrical base which is adapted for engagement in said cutter and an exposed upper inwardly converging portion terminating in a generally convex earth engaging surface with one portion thereof comprised of said first material and the remaining portion comprised of said second material with the interface between said materials lying within said generally convex portion.

6. The rock bit insert according to claim 5 where said cylindrical base is made completely from said first material.

7. The rock bit insert according to claim 5 wherein said cylindrical base is made completely from said second material.

8. A dual component sintered rock bit insert for attachment in a rolling rock bit cutter comprising:

a body formed of a first component joined along a mating plane to a second component and said mating plane substantially dividing said insert into two equal halves, said first component having a resistance to wear less than said second component, and means on said body permitting the mounting of said body on the rock bit cutter such that the mating plane is oriented to position said first component as the leading edge of the insert as said cutter is rotated to effect cutting.

9. The rock bit insert according to claim 8 wherein said first component is sintered tungsten carbide and said second component is sintered tungsten carbide, the first component having a hardness less than that of said second material such that said first material has a lesser resistance to wear than the second material.

10. The rock bit insert according to claim 8 wherein said first and second components comprise sintered tungsten carbide with said first component having a greater percentage by weight of cobalt than said second component.

11. The rock bit insert according to claim 8 wherein said body has a cylindrical base which is adapted for engagement in said cutter and an exposed upper inwardly converging portion terminating in a generally convex earth engaging surface with one portion thereof comprised of said first component and the remaining portion comprised of said second component with the interface between said components lying within said generally convex portion.

12. A composite sintered rock bit insert comprising:

a body having a substantially cylindrical base on one end and a tip portion extending from said base converging inwardly therefrom and terminating in a generally convex earth engaging surface, said tip portion comprises of a first material joined along a mating plane to a second material, said first material having a resistance to wear less than that of said second material, and said mating plane engaging said generally convex surface and extending therefrom toward said cylindrical base in a configuration providing that the outer surfaces of both said first and second materials diverge away from said mating surface to provide in said tip portion progressive increasing distances of said outer surfaces from said mating surface in the direction of said cylindrical base.

13. The rock bit insert according to claim 12 wherein said first material is sintered tungsten carbide and said second material is sintered tungsten carbide, the first material having a hardness less than that of said second material such that said first material has a lesser resistance to wear than the second material.

14. The rock bit insert according to claim 12 wherein said first and second materials comprise sintered tungsten carbide with said first material having a greater percentage of cobalt than said second material.

15. The rock bit insert according to the claim 12 wherein said mating plane is oriented substantially perpendicular to the direction of movement of said insert on the rock bit cutter as the rock bit cutter is moved to effect cutting.

16. A composite sintered rock bit insert for attachment in a rolling rock bit cutter comprising:

a body having a substantially cylindrical base on one end and a tip on the opposite end, said tip extending from said base converging inwardly therefrom and terminating in a generally convex earth engaging surface, said tip comprised of a first component joined along a mating plane to a second component, said mating plane being substantially perpendicular to the direction of movement of said insert as said cutter is moved to effect cutting.

17. The rock insert according to claim 16 wherein said first component is the leading edge of the body as the cutter is moved to effect cutting.

18. The rock bit insert according to claim 16 wherein said first component is sintered tungsten carbide and said second material is sintered tungsten carbide, the first material having a hardness less than that of said second material such that said first material has a lesser resistance to wear than the second material.

19. The rock bit insert according to claim 16 wherein said first and second components comprise sintered tungsten carbide with said first component having a greater percent by weight of cobalt than said second component.

20. A dual component sintered rock bit insert comprising:

a first component defining a first surface of said insert; and a second component joined along a mating surface to said first component and defining a second surface of said insert, said second component having a resistance to wear greater than that of said first component, said mating surface substantially dividing said insert into equal halves.

21. The rock bit insert according to claim 20 wherein said first surface is the leading surface of said rock bit as it is employed in a grating action and said second surface is the trailing surface.

22. The rock bit insert according to claim 20 wherein said first component is sintered tungsten carbide and said second component is sintered tungsten carbide, the first component having a hardness less than that of said second component such that said first material has a lesser resistance to wear than the second material.

23. The rock bit insert according to claim 20 wherein said first and second components sintered tungsten carbide with said first component having a greater percent by weight of cobalt than said second component.

24. The rock bit insert according to the claim 20 wherein said mating surface is oriented substantially perpendicular to the direction of movement of said insert on the rock bit cutter as the rock bit cutter is moved to effect cutting.

25. A rock bit cutter comprising:

a rotatable drill bit having a plurality of sintered composite inserts mounted in the working face thereof, said inserts having a body with a first portion comprised of a first material joined along a mating surface to a second portion comprised of a second material, said first material having a resistance to wear less than said second material and said mating surface extending to an earth engaging surface of the insert, said first portion of the insert being oriented to be the leading edge of the insert as said cutter is moved to effect cutting.

26. The rock bit cutter according to claim 25 wherein said inserts comprise an exposed tip inwardly converging from the drill bit and terminating in a generally convex earth engaging surface with one portion of said tip comprised of the less wear resistant material and said second portion comprised of the more wear resistant material, the interface between said materials engaging said generally convex surface.

27. The rock bit cutter according to claim 26 having a relative resistance to wear between said first and second materials to provide that the crest of the convex earth engaging surface of the exposed tip is moved progressively away from the leading edge of said inserts as said inserts are worn during drilling.

28. The rock bit cutter according to claim 25 wherein said first material is sintered tungsten carbide and said second material is sintered tungsten carbide, the first material having a hardness less than that of said second material such that said first material has a lesser resistance to wear than the second material.

29. The rock bit cutter according to the claim 25 wherein the first portion of said body is joined to the second portion of said body along a mating plane and wherein said plane is oriented substantially perpendicular to the direction of movement of said insert on the rock bit cutter as the rock bit cutter is moved to effect cutting.

30. The rock bit cutter according to claim 25 wherein said second material has a lower transverse rupture strength than that of said first material.

31. The rock bit cutter according to claim 25 wherein the composite transverse rupture strength of said composite inserts is greater than the transverse rupture strength of said second material.

32. The rock bit cutter according to claim 31 wherein said composite transverse rupture strength is closer in value to the transverse rupture strength of said first material than to the transverse rupture strength of said second material.

33. A rotatable drill bit comprising:

a rolling cutter having a face and a plurality of apertures therein;

a plurality of sintered tungsten carbide rock bit inserts for insertion into said rolling cutter, said rock bit inserts having a tip portion and a base portion, said base portion sized to be receivable in the apertures in said rolling cutter so that the tip portion of said insert protrudes beyond the face of said rolling cutter; and said tip comprising first and second components separated by a mating plane wherein said second component has greater wear resistance than said first component, said first component being positioned to serve as the leading surface of the rock bit insert during rotation of said drill bit.

34. The drill bit according to claim 33 wherein said tip portion is shaped to form a crest-like configuration thereon, and said mating plane being positioned normal to the direction of movement of said insert as the drill bit is rotated.

35. The drill bit according to claim 33 wherein said first component is sintered tungsten carbide and said second component is sintered tungsten carbide, the first component having a hardness less than that of said second component such that said first material has a lesser resistance to wear than the second material.

36. The drill bit according to claim 33 wherein said mating plane is oriented substantially perpendicular to the direction of movement of said insert on the drill bit as the drill bit is moved to effect cutting.

37. In a rotary earth drilling bit, the combination comprising:

a rolling cutter member mounted in said drill bit for rotation about a rotational axis of said cutter member and having an external working face;

a plurality of composite sintered bit inserts spaced radially around the working face of said rolling cutter member at a plurality of radial locations spaced longitudinally along said rotational axis, said inserts having a first portion comprised of a first material and joined to a second portion comprised of a second material said first material having a lower wear resistance then that of said second material and said first portion being oriented to be the leading edge of said bit inserts as said rolling cutter member is rotated in a drilling operation.

38. The combination of claim 37 wherein said first material has a higher transverse rupture strength than said second material.

39. The combination of claim 38 wherein said first material has a substantially greater wear resistance than that of the working face of said rolling cutter member.

* * * * *